US010400419B2

(12) United States Patent
Hart et al.

(10) Patent No.: US 10,400,419 B2
(45) Date of Patent: Sep. 3, 2019

(54) COUPLER

(71) Applicants: Gerome Rangi Hart, Masterton (NZ); Isaac John Hart, Masterton (NZ)

(72) Inventors: Gerome Rangi Hart, Masterton (NZ); Isaac John Hart, Masterton (NZ)

( * ) Notice: Subject to any disclaimer, the term of this patent is extended or adjusted under 35 U.S.C. 154(b) by 0 days.

(21) Appl. No.: 15/578,848

(22) PCT Filed: Aug. 28, 2015

(86) PCT No.: PCT/NZ2015/050125
§ 371 (c)(1),
(2) Date: Dec. 1, 2017

(87) PCT Pub. No.: WO2016/195512
PCT Pub. Date: Dec. 8, 2016

(65) Prior Publication Data

US 2018/0148903 A1 May 31, 2018

(30) Foreign Application Priority Data

Jun. 4, 2015 (NZ) ..... 708831

(51) Int. Cl.
*E02F 3/36* (2006.01)

(52) U.S. Cl.
CPC ..... *E02F 3/3627* (2013.01); *E02F 3/3663* (2013.01)

(58) Field of Classification Search
CPC ..... E02F 3/3627; E02F 3/3663; E02F 3/365; E02F 3/3618
See application file for complete search history.

(56) References Cited

U.S. PATENT DOCUMENTS

| | | | | |
|---|---|---|---|---|
| 4,881,867 | A * | 11/1989 | Essex | E02F 3/3622 414/723 |
| 5,692,325 | A * | 12/1997 | Kuzutani | E02F 3/3618 37/406 |
| 6,379,075 | B1 * | 4/2002 | Shamblin | E02F 3/3613 37/468 |
| 6,964,122 | B2 * | 11/2005 | Cunningham | E02F 3/3618 37/468 |
| 8,151,494 | B2 * | 4/2012 | Scheib | E02F 3/3618 37/468 |
| 8,678,697 | B2 | 3/2014 | Monaghan et al. | |
| 8,684,623 | B2 * | 4/2014 | Robl | F16D 1/00 37/468 |
| 8,782,931 | B2 * | 7/2014 | Balemi | E02F 3/3618 37/468 |
| 9,670,642 | B2 * | 6/2017 | Pesch | E02F 3/3618 |
| 2003/0175072 | A1 | 9/2003 | Steig, Jr. et al. | |
| 2012/0201598 | A1 | 8/2012 | Scheib et al. | |
| 2013/0160269 | A1 | 6/2013 | Parker et al. | |
| 2013/0234415 | A1 | 9/2013 | Essex | |

(Continued)

FOREIGN PATENT DOCUMENTS

WO WO2014/098616 6/2014

OTHER PUBLICATIONS

International Search Report, PCT/NZ2015/050125 dated Sep. 18, 2016.

*Primary Examiner* — Jamie L McGowan
(74) *Attorney, Agent, or Firm* — Karish & Bjorgum, PC

(57) ABSTRACT

This invention relates to a coupler for coupling an accessory or work attachments or implements to a vehicle, such as a dipper arm an excavator or similar vehicle.

10 Claims, 8 Drawing Sheets

(56) References Cited

U.S. PATENT DOCUMENTS

| | | | | |
|---|---|---|---|---|
| 2014/0294497 | A1* | 10/2014 | Robl | E02F 3/3622<br>403/376 |
| 2015/0330053 | A1* | 11/2015 | Ravindran | E02F 3/3618<br>29/426.5 |

* cited by examiner

COUPLER

FIELD OF THE INVENTION

This invention relates to a coupler for coupling an accessory or work attachments or implements to a vehicle, such as a dipper arm an excavator or similar vehicle.

BACKGROUND TO THE INVENTION

Hydraulically operated couplers (also known as quick hitches or quick couplers) are well known in the excavator industry and are typically used for coupling an excavator to a range of work attachments or implements. Such attachments would include a tilting bucket, a rock bucket, a trench bucket, a grapple, a hydraulic jack hammer, and various others. It is typical that such attachments are able to be remotely and hydraulically coupled to the coupler via two parallel connecting pins on the attachments. The coupler is a key part of equipment for an excavator and an excavator operator can change attachments many times per day.

A critical aspect of working in the excavator industry is safety. While many couplers for coupling attachments have been described such as that described in WO2014/098616 the system described is complex and involves many moving parts and linkages that are vulnerable to failure. Because of its complexity the system described in WO2014/098616 is more likely to be used on large couplers rather than small coupling systems. The complex coupling systems are more difficult to maintain and more expensive to produce, which introduces economical barriers for businesses. There is also more opportunity for components to fail and for the safety of the coupler to be compromised.

It is therefore an object of the present invention to provide a coupler which is simple to produce and which will continue to lock onto the attachment even in the event of a hydraulic cylinder failure, or to at least provide the public with a useful choice.

SUMMARY OF THE INVENTION

In a first aspect, the invention provides a coupler assembly for coupling an attachment to a vehicle, the attachment having a first connecting pin and a second connecting pin, the coupler having;

a chassis that is connectable to the vehicle, the chassis supporting a first component having a first dock that in use receives the first connecting pin of the attachment and the chassis further supporting a second component, the second component having at least one second dock that in use receives the second connecting pin of the attachment; wherein the second component is a slidable assembly slidable in a forward and aft direction relative to the first dock;

an actuator that in use controls the position of the slidable assembly relative to the position of the first component; and wherein the slidable assembly includes a slidable plate onto which is mounted on a top side of the plate at least one connecting pin locking member and on the other side of the plate is mounted the at least one second dock, wherein in use the connecting pin locking member is actuated from a retracted position above the slidable plate to an extended position below the slidable plate, which extended position in use, prevents the release of the second pin from the second dock.

In a second aspect, the invention provides a coupler assembly for coupling an attachment to a vehicle, the attachment having a first connecting pin and a second connecting pin, the coupler having;

a chassis that is connectable to the vehicle, the chassis supporting a first component having at least one first dock that in use receives the first connecting pin of the attachment and the chassis further supporting a second component having at least one second dock that in use receives the second connecting pin of the attachment; wherein the second component is a slidable assembly slidable in a forward and aft direction relative to the first dock; and wherein the second component includes a connecting pin locking member, which in use is actuated by an actuator from a retracted position to an extended position to prevent the release of the second connecting pin from the dock by an actuator, the same actuator further controlling the position of the slidable second component relative to the position of the first component.

In one embodiment the at least one rear connecting pin locking member extends through a complimentary shaped slot in the slidable assembly into its extended position.

In one embodiment the at least one rear connecting pin locking member is substantially "C"-shaped.

In another embodiment the slidable assembly includes a pair of rear connecting pin locking members. In one embodiment the pair of connecting pin locking members are spaced apart and proximate the side edges of the slidable assembly.

In another embodiment each rear connecting pin locking member is biased by a biasing means into its extended position.

In an embodiment having a pair of rear connecting pin locking members each rear connecting pin locking member is independently biased by a biasing means into its extended position.

In one embodiment the first component further includes a pivotable safety hook. In one embodiment the pivotable safety hook is adapted such that in use the safety hook is pivotable out of engagement in the front dock by actuating the slidable assembly to move the rear dock to its most forward position.

DESCRIPTION

Further aspects of the present invention will become apparent from the following description which is given by way of example only and with reference to the accompanying figures in which.

EXAMPLE

With reference to FIGS. 1 to 13, an example of a coupler 1 is shown in various perspective views and in a series of side views showing the features of the coupler. The coupler 1 is of the type typically used for coupling attachments such as a tilting bucket, a rock bucket, a trench bucket, a grapple, a hydraulic jack hammer and various others. The only requirement for the coupling attachment is that it has two parallel connecting pins on the attachment. The preferred diameter size of the connecting pins is 38 or 40 mm, however it is envisaged that a coupling attachment could be scaled up and built for an attachment that has connecting pins having a diameter of 120 mm or more. In the following description, reference is made to the parallel connecting pins as a first connecting pin and a second connecting pin. The coupler is used to couple an attachment having such first and second connecting pins to a vehicle such as an excavator, dipper arm or the like.

Figure 1:
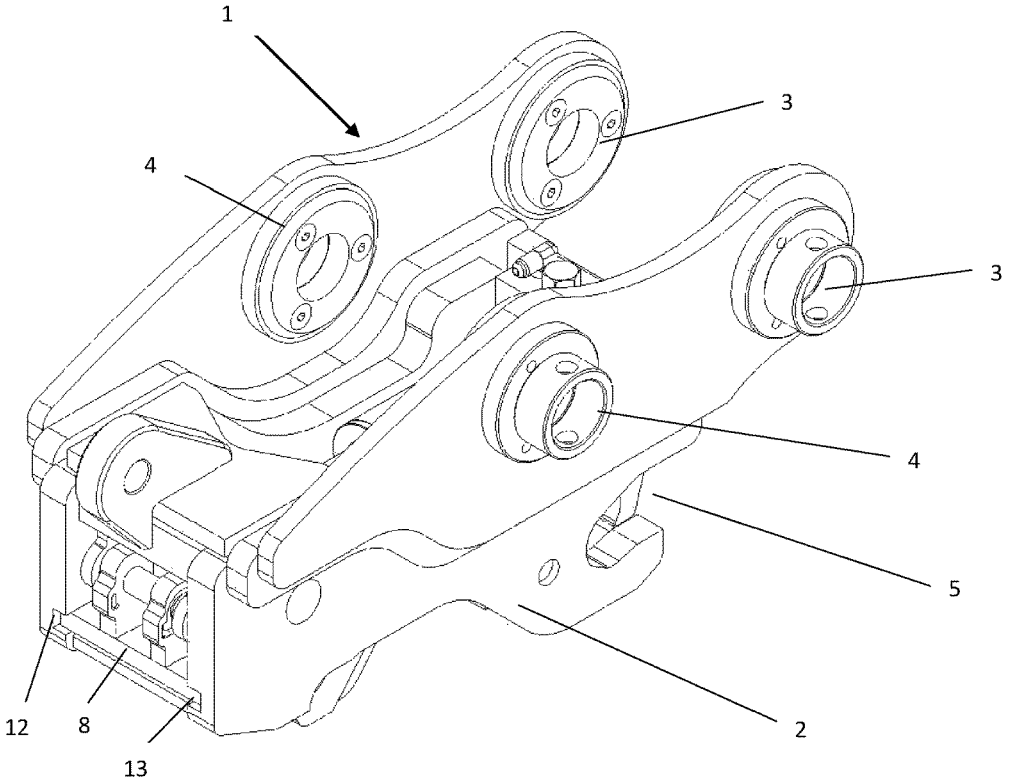
FIG. 1 shows a top rear perspective view of a coupler of the present invention.
Figure 2:
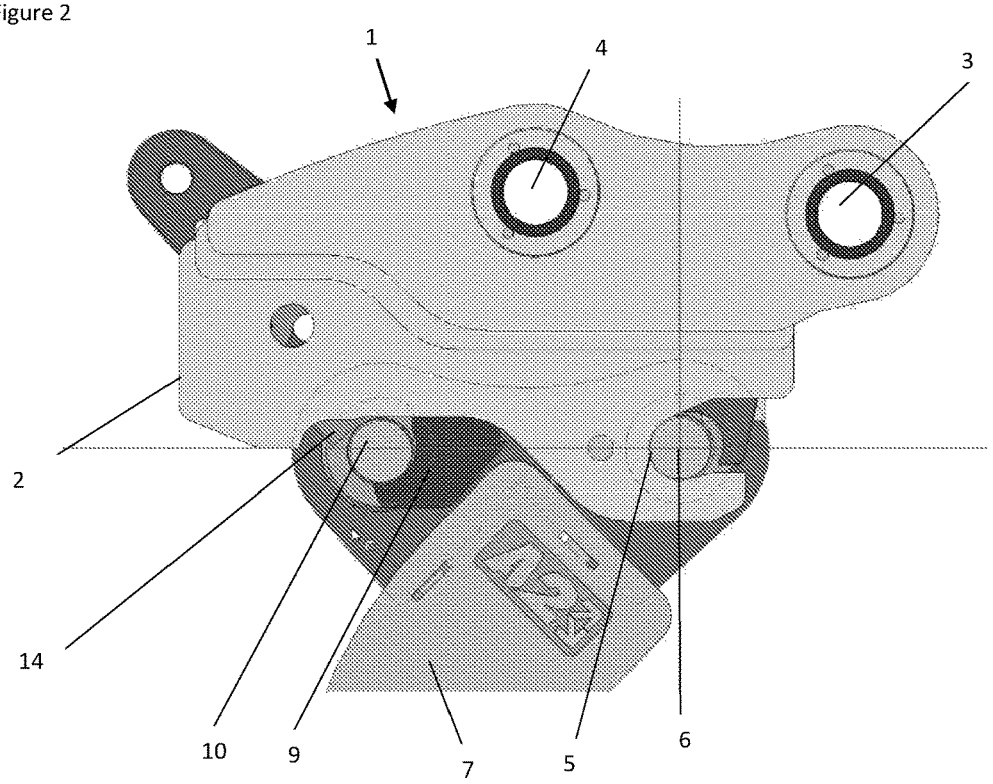
FIG. 2 shows a side view of the coupler coupled onto an attachment through the connecting pins of the attachment and wherein the front and rear safety locks are in their respective locking positions.
Figure 3:
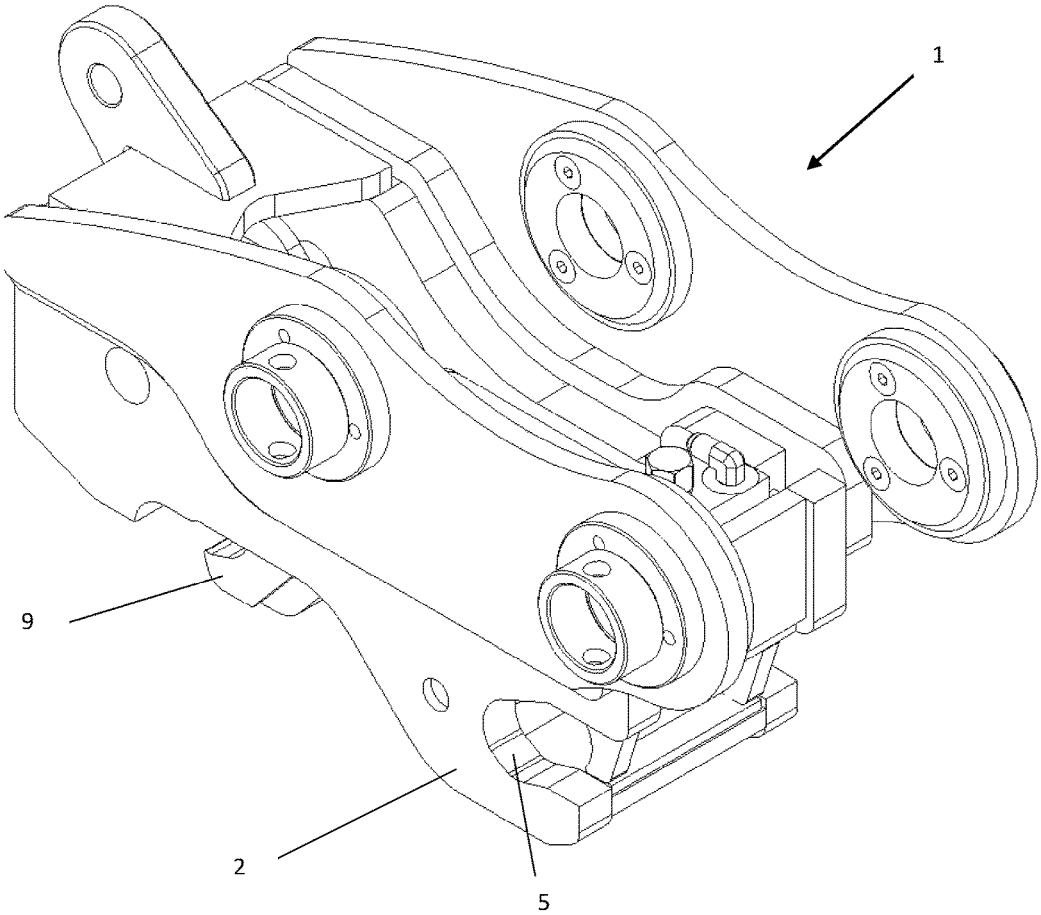
FIG. 3 shows a top front perspective view of the coupler.

It can be seen in FIGS. 1 and 2 that the coupler has a chassis 2 that is connectable to the vehicle through forward and rear attachment members 3 and 4 and which are used to connect the coupler 1 to the end of an arm of a vehicle (not shown). With reference to FIG. 2, the chassis includes a first, front or forward dock 5 for receiving the first, front or forward connecting pin 6 of an attachment 7.

Figure 4:
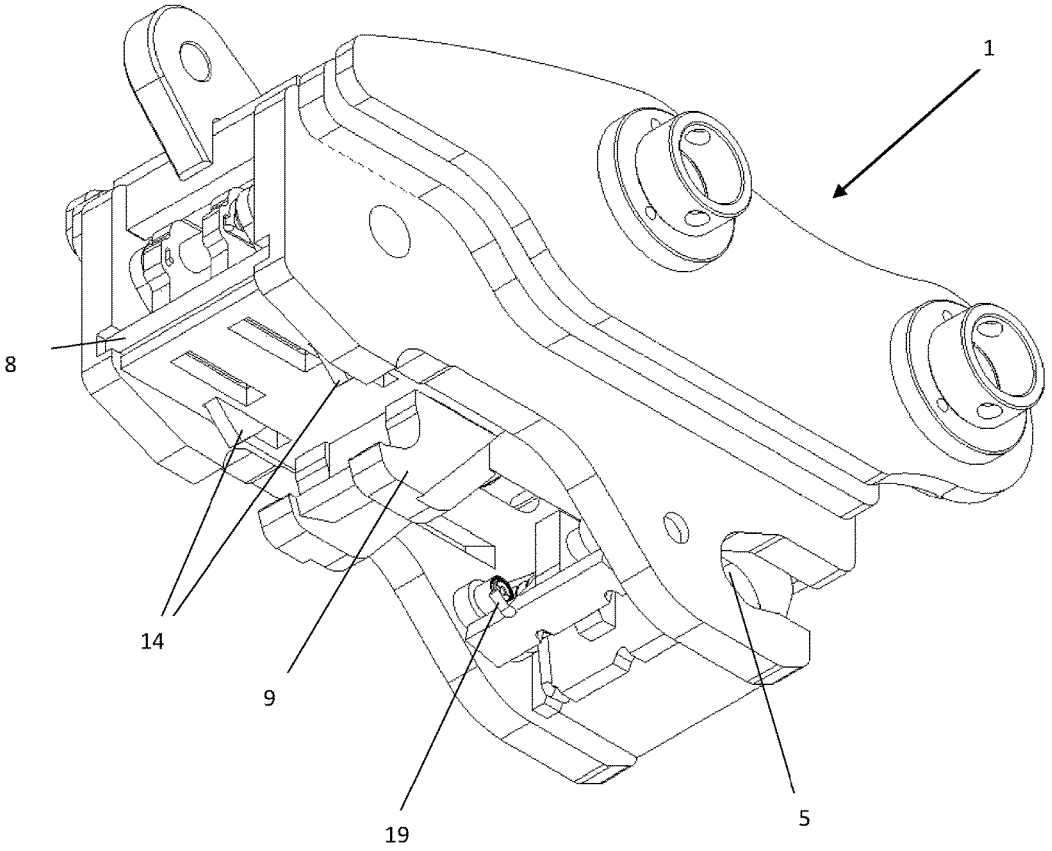
FIG. 4 shows a rear bottom perspective view of the coupler.
Figure 5:
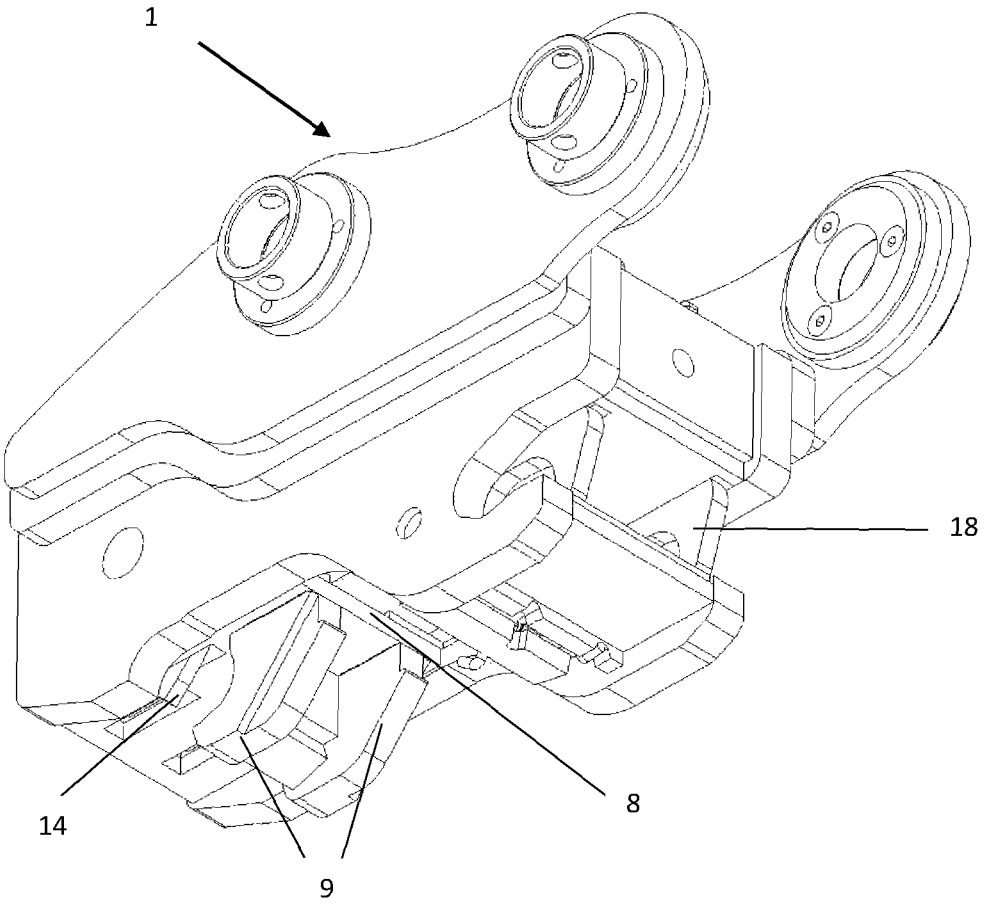
FIG. 5 shows a front bottom perspective view of the coupler.
Figure 6:
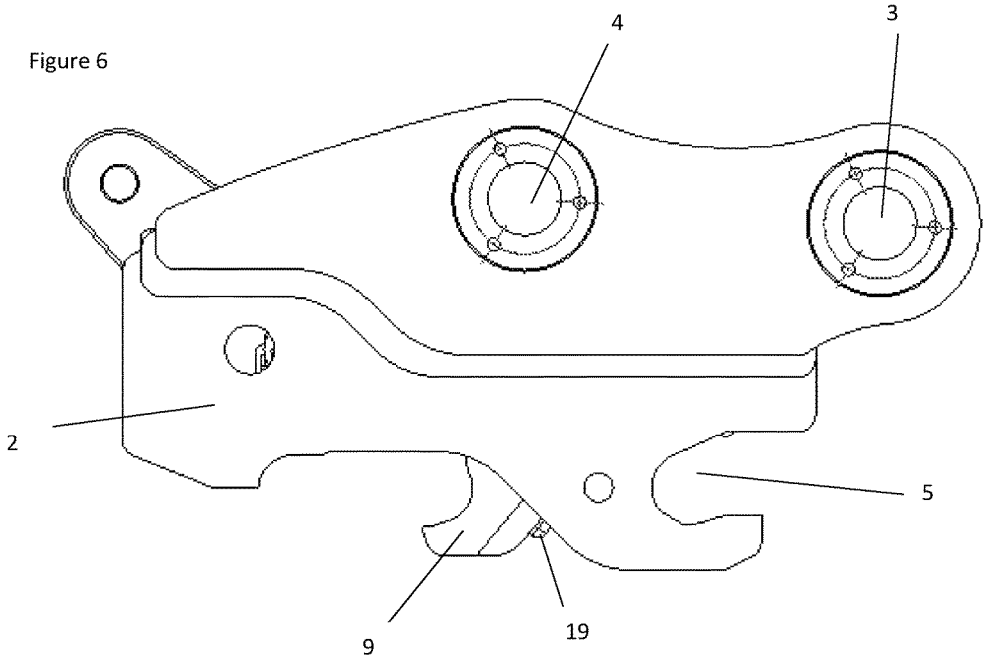
FIG. 6 shows a side view of the coupler.
Figure 10:
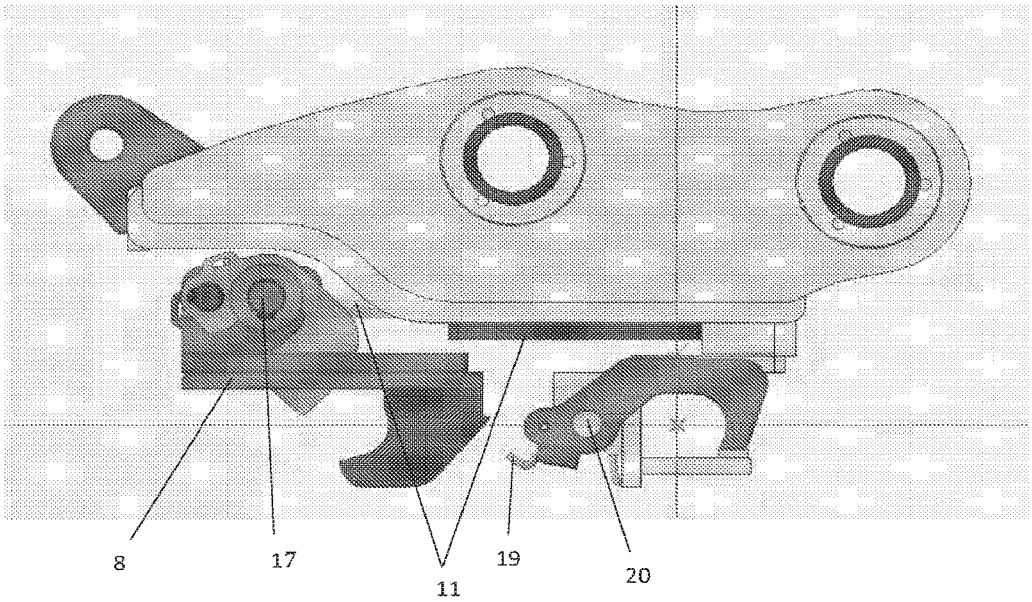
FIG. 10 shows an alternative presentation of the side view of the coupler with the front safety hook in an engaged position and the rear safety lock in an extended position.

The coupler also includes a slidable assembly 8, best illustrated in FIG. 10, which is supported by the chassis 1 (See FIGS. 1 and 4). The slidable assembly 8 is movable through a range of travel relative to the chassis 2. The range of travel of the slidable assembly 8 is substantially in a forward and aft direction relative to the front dock. The slidable assembly 8 provides the second, aft or rear dock 9 of the coupler 1 for receiving the second, aft or rear connecting pin 10 of an attachment 7 as seen in FIG. 2.

Figure 7:
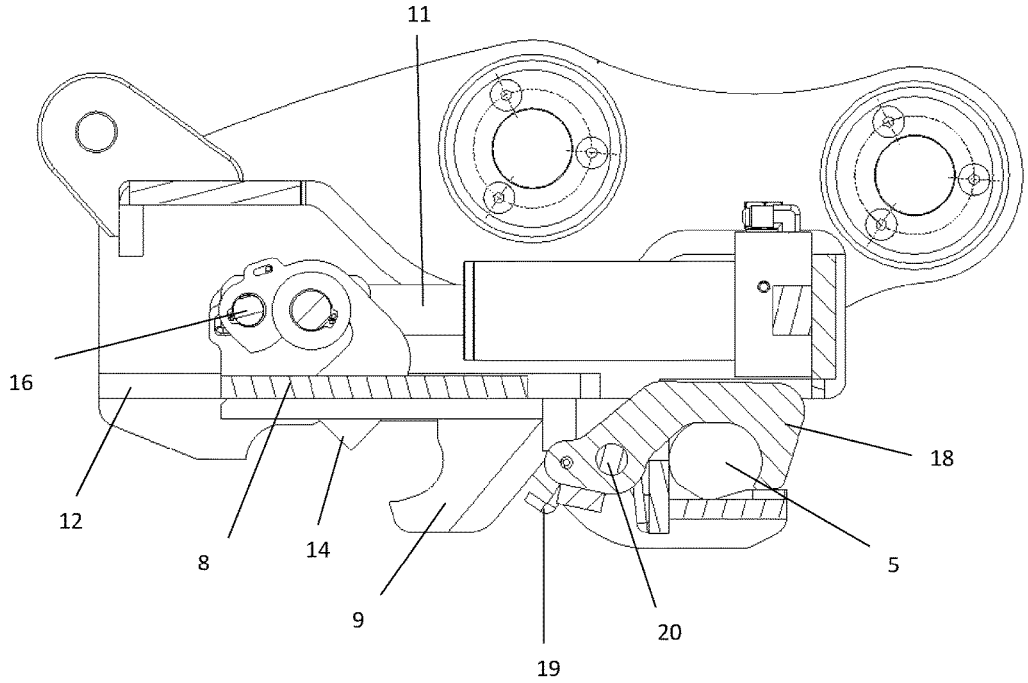
FIG. 7 shows a side view of the coupler with the chassis covering removed with its front safety hook in an engaged position and the rear safety lock in an extended position and the rear dock being in an intermediate position along the chassis.

With reference to FIGS. 7 to 13 an actuator 11 (hydraulic cylinder) of the coupler is used to move the slidable assembly 8 forward and aft relative to the front dock 5. With reference to FIG. 7 the slidable assembly 8 is supported by grooves 12 and 13 one each side of the chassis 2 (see FIG. 1). The slidable assembly 8 can be actuated by the actuator 11 in a forward or aft direction along the chassis 2 either towards or away from the front dock 5.

Figure 11:
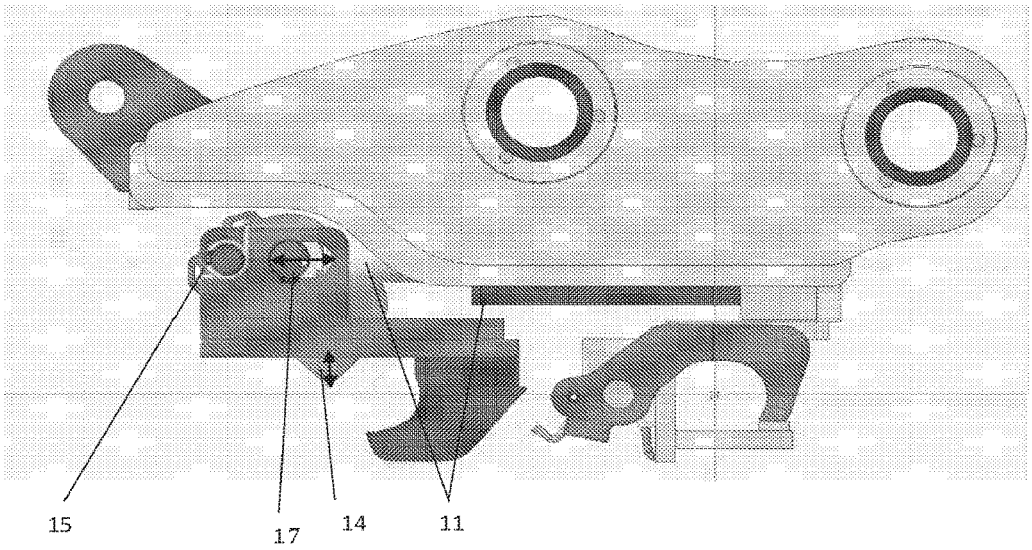
FIG. 11 shows the equivalent side view of the coupler shown in FIG. 10 with the rear safety lock on one side removed to show the biasing means of the rear safety lock and the slot in which the rear safety lock lifting pin travels to either lift or lower the rear safety lock out of or into its extended locking position.

With reference to FIG. 7, the slidable assembly 8 includes at least one rear pin locking member 14. The rear pin locking member 14 is movable from an extended position in which the rear pin locking member prevents the second connecting pin from exiting the rear dock. In the embodiment shown in the Figures a pair of rear pin locking members 14 are utilised (see FIG. 4). Each rear locking pin member 14 is independently biased by a biasing means 15 at the pivot point 16 of the locking pin member 14, as shown in FIG. 11. Each rear pin locking member 14 is lifted into or out of its extended locking position by a control pin 17 that can be moved forward or aft relative to the front dock 5 by the actuator 11. This is best illustrated in FIGS. 12 and 13.

Figure 12:
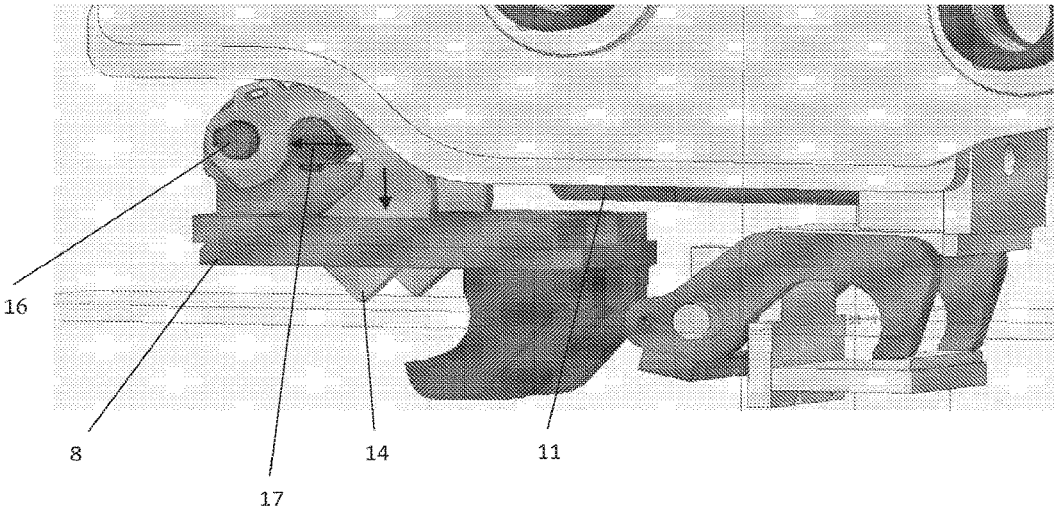
FIG. 12 shows a perspective side view of a portion of the rear safety lock of the coupler showing the direction in which the rear safety lock lifting pin travels to lower the rear safety lock into its extended locking position.
Figure 13:
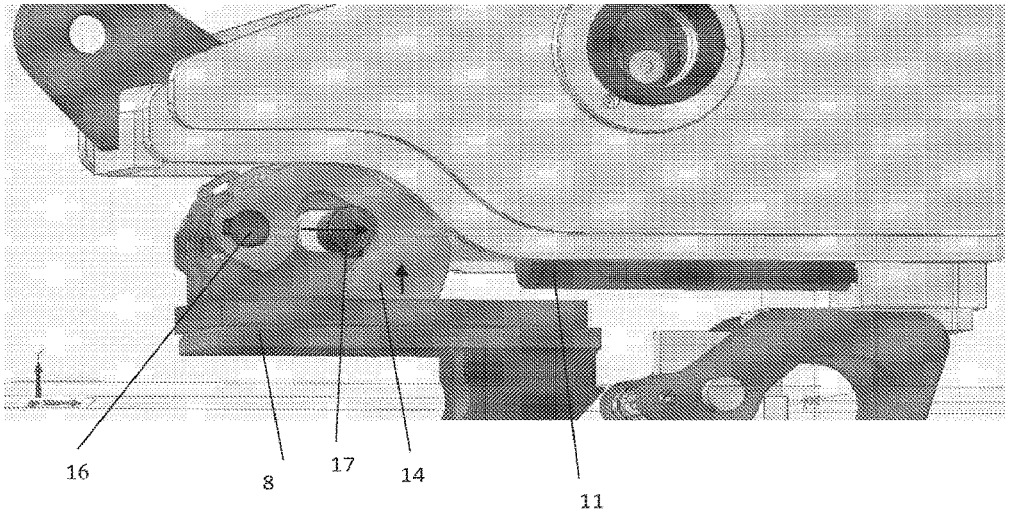
FIG. 13 shows a side view of a portion of the rear safety lock showing the direction in which the rear safety lock lifting pin travels to lift the rear safety lock out of its extended locking position into its retracted position.

With reference to FIG. 12, if the control pin 17 is moved aft by the actuator 11, the rear pin locking member 14 is extended into engagement by passing through a slot in the slide assembly and into the area above the rear dock, which in use prevents the exit of the connecting pin from the rear dock 9. With reference to FIG. 13, if the control pin 17 is moved forward by the actuator 11, the rear locking member is lifted out of or retracted through the slot in the slide assembly and out of the area above the rear dock, which in use will allow the exit of the connecting pin from the rear dock 9. As mentioned above, with reference to FIG. 11, each rear locking member includes a biasing means 15 to bias each rear locking member into its locking position, that is, a configuration which, in use, keeps the rear locking member biased towards its extended position. In addition to this, the "C"-shape of the rear locking member, the shape of the slots through which the rear locking member extends and the location of the control pin 17 when the rear locking member is extended all interact in a manner, which means that it is mechanically impossible, even in the event of a hydraulic cylinder failure, for the connecting pin to exit the rear dock 9 when the rear locking member is extended. In other words, each rear locking member also provides a mechanical lock to prevent the connecting pin from exiting the rear dock. This is a critical aspect to the safety of the coupler 1 because even if the actuator 11 or associated hydraulics fail the attachment 2 coupled to the coupler 1 will still be held safely in position because of the mechanical locking of the rear locking members thereby preventing the exit of the rear connecting pin out of the rear dock and therefor potentially preventing serious injury, harm or even death.

In the embodiment illustrated in FIGS. 1 to 13 the coupler 1 further includes a pivotable safety hook 18 for the first dock 5. The pivotable safety hook 18 is movable between an extended position, in which, in use the pivotable safety hook 18 prevents the first connecting pin from exiting the front dock 9 and a retracted position, in which the pivotable safety hook 18 does not prevent the front connecting pin exiting the front dock 5.

Figure 8:
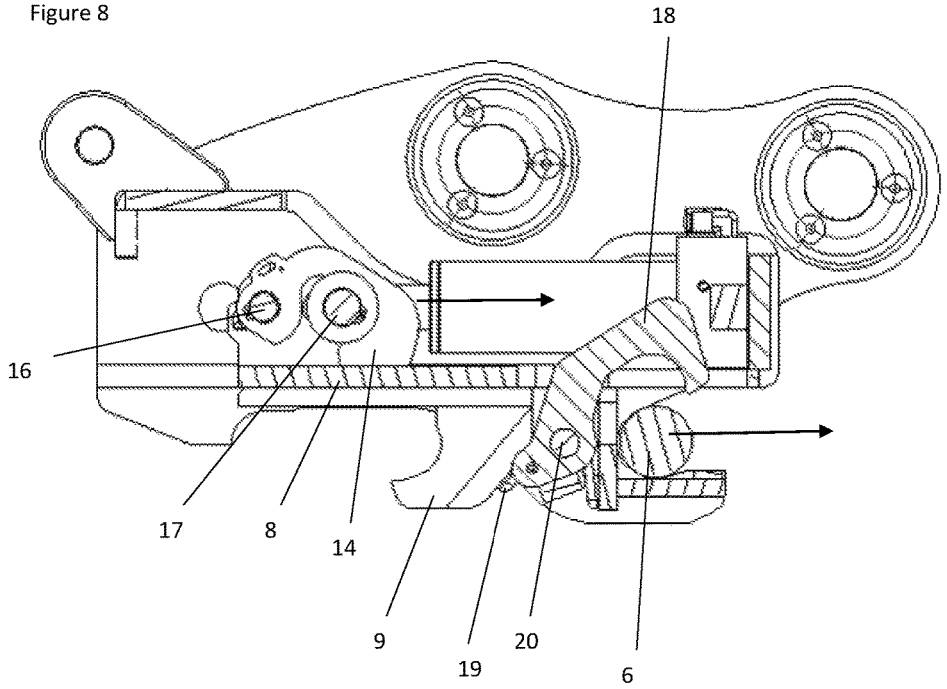
FIG. 8 shows a side view of the coupler with the front safety hook in its retracted position, the rear dock in its most forward position on the chassis and the rear safety lock in a retracted position.
Figure 9:
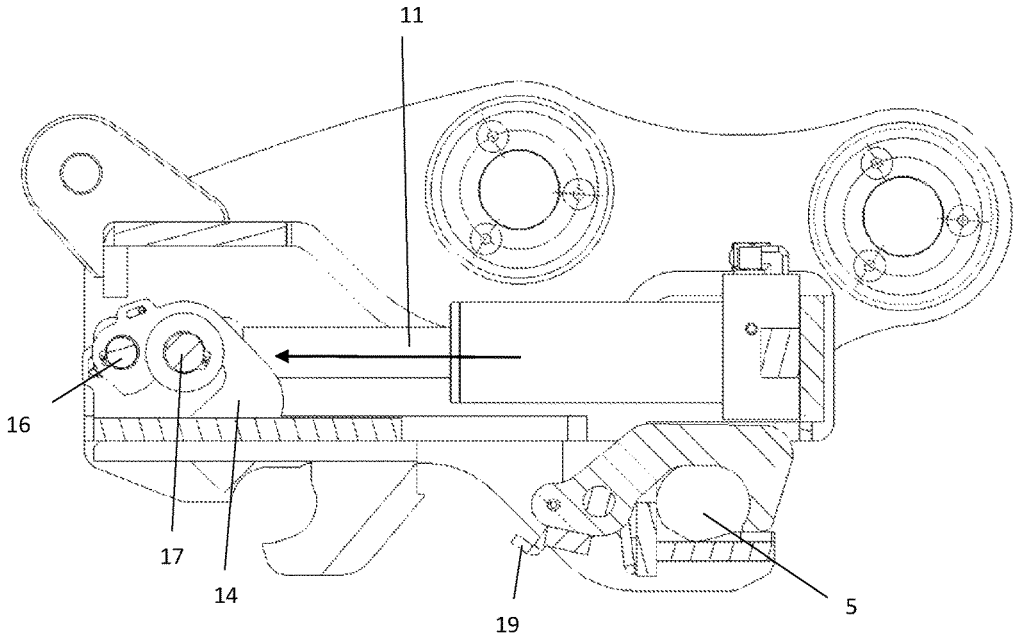
FIG. 9 shows a side view of the coupler shown with the front safety hook in an engaged position and the rear safety lock in an extended position with the rear dock in its most aft position on the chassis.

The pivotable safety hook 18 is actuated by actuation of the hydraulic cylinder 11 to bring the slidable assembly to its forward most position so that the rear dock 9 bears upon lever 19 to pivot the safety hook 18 about its pivot point 20 and thereby retract the safety hook 18 out of the front dock as illustrated in FIG. 8. The pivotable safety hook 18 is released back into its extended safety position by moving the slidable assembly back to a point where the rear dock 9 no longer bears upon lever 19. The pivotable safety hook 18 is biased into its extended safety position as its default position. The safety hook 18 can only be retracted when the slidable assembly and rear dock are moved forward to bear upon the pivot lever 19.

In use the operator of the vehicle to which the coupler is attached will select an attachment the operator wishes to use. The operator will couple the coupler to the attachment by first actuating the hydraulic cylinder 11 to drive the slide assembly 8 forward so that the rear dock 9 bears upon the lever 19 of the safety hook 18 to pivot the safety hook about its pivot point 20 to thereby retract the safety hook out of the front dock as shown in FIG. 8. The operator will then engage the front connecting pin 6 of the attachment into the front dock and will then immediately actuate the slide assembly 8 back to release the dock 9 from bearing on the lever 19 to thereby return the safety hook into its biased retention position as shown in FIG. 7. The operator then actuates the cylinder 11 to drive the slidable assembly aft such that the rear dock can receive the second rear connecting pin of the attachment. The action of the connecting pin going into the rear dock will touch the extended rear pin locking member and the locking member will rub over the top of the connecting pin and mechanically lock in place as soon as the connecting pin is seated in the dock 9. At this point the attachment means is fully engaged and coupled to the coupler as is shown in FIG. 2. The attachment is retained safely in place by both front and rear locking members.

To disconnect the attachment from the coupler, the operator will actuate the hydraulic cylinder 11 to drive the slidable assembly 8 forward enough to pull the pin control 17 forward as shown in FIG. 13. This lifts the rear pin locking member 14 out of engagement with the connecting pin of the attachment and causes the retraction of the rear pin locking member into the slidable assembly out of the docking area. Once this is achieved, the second connecting pin is released from the dock and the slidable assembly 8 is then actuated by the hydraulic actuator 11 to its most forward position (see FIG. 8) such that the rear dock bears upon the lever 19 of the front safety lock 18 causing it to pivot around its pivot point 20 out of engagement with the front connecting pin 6. Once this has occurred, the front connecting pin 6 can be readily removed from the front dock.

Manufacturing

The coupler is designed in a simple way so that the parts interlock. Preferably, the steel is made from Bis 400 and Bis 80 or other high grade steel so the coupler has a high strength and is less likely to fail. The steel is cut either by laser cutting or high definition plasma cutting. All holes are machined to ensure a good fit with machined pins. Biasing means or springs are made from stainless steel to ensure that rust will not cause problems and so that the biasing means do not deteriorate over time. Preferably, the front safety lock is made from Bis 400 so that it will not wear and is extremely strong.

Once all parts have been procured, cut and machined, the parts can then be fabricated into the coupler. The chassis is the first part to be fabricated. To do this, all parts are tacked up in accordance with the drawings following good engineering practice. This means all parts being square, accurate and detailed for the welding process. Once all parts have been tacked together, the chassis is then fully welded. Following this, the front locking system is fabricated in accordance with a fabrication plan. The front locking system is fully welded after checking the fit with the coupler. Following this, the slidable assembly is fabricated. Welding is done from both sides of the parts to ensure that the strength and attachment of the parts in the coupler are optimised. The hydraulic cylinder is manufactured with a CNC built base that incorporates a check valve as well as the ports to operate the cylinder meaning that all hosing to the cylinder is routed very effectively. Once the coupler has been fully fabricated, the coupler can then be sent for final machining. Following machining, a quality check is then undertaken. If the coupler passes the quality check, it is then sent for a full blast, undercoat and final painting, after which the coupler will be fully assembled and quality checked.

The coupler, once installed on a vehicle is run using a conventional hydraulic system with 2 ports. The electrical connection is also conventional.

It is to be appreciated that the scope of the present invention is not intended to be limited to the particular embodiments of any means, part, assembly, process or manufacture, methods, and/or steps described in the specification. Various modifications, substitutions, and variations can be made to the disclosed material or integers mentioned herein without departing from the scope and/or essential characteristics of the present invention. Accordingly, one of ordinary skill in the art will readily appreciate from the disclosure that later modifications, substitutions, and/or variations performing substantially the same function or achieving substantially the same result as embodiments described herein may be utilized according to such related embodiments of the present invention.

What is claimed is:

1. A coupler assembly for coupling an attachment to a vehicle, the attachment having a forward connecting pin and a rear connecting pin, the coupler having;

a chassis that is connectable to the vehicle, the chassis supporting a first component having a forward dock that is configured to receive the forward connecting pin of the attachment and the chassis further supporting a second component, the second component having at least one rear dock that is configured to receive the rear connecting pin of the attachment; wherein the second component is a slidable assembly slidable in a forward and aft direction relative to the forward dock;

an actuator that is configured to control the position of the slidable assembly relative to the position of the first component;

wherein the slidable assembly includes a slidable plate onto which is mounted on a top side of the plate at least one rear connecting pin locking member and on the other side of the plate is mounted the at least one rear dock wherein the at least one rear connecting pin locking member has a substantially "C" shape and this substantially "C" shape curves over a control pin, and the control pin is movable by the actuator so as to move the control pin forwards and rearwards relative to the chassis;

wherein the at least one rear connecting pin locking member is movable to an extended position by the actuator moving the control pin rearwards relative to the chassis;

thereby causing the at least one rear connecting pin locking member to move from a retracted position above at least one complementary shaped slot in the slidable plate, downwards through the at least one complementary shaped slot in the slidable plate; and thereby transitioning the at least one rear connecting pin locking member to the extended-position which extended position engages with and locks in place the rear connecting pin and thereby prevents the release of the rear connecting rear dock; and wherein the at least one rear connecting pin locking member is movable to the retracted position by the actuator moving the control pin forwards relative to the chassis;

thereby causing the at least one rear connecting pin locking member to move upwards through the at least one complementary shaped slot in the slidable plate; and thereby transitioning the at least one rear connecting pin locking member to the retracted position that is above the at least one complementary shaped slot in the slidable plate, which retracted position disengages from and releases the rear connecting pin and thereby allows release of the rear connecting pin from the rear dock; and wherein the at least one rear connecting pin locking member is a pair of connecting pin locking members, and for the pair of rear connecting pin locking members, each rear connecting pin locking member is independently biased by a biasing means into its extended position.

2. The coupler assembly as claimed in claim least 1 wherein the at least one complementary shaped slot is a pair of complementary shaped slots.

3. The coupler assembly as claimed in claim 2 wherein the pair of rear connecting pin locking members are spaced apart and proximate the side edges of the slidable assembly.

4. The coupler assembly as claimed in claim 1 wherein the front component further includes a pivotable safety hook.

5. The coupler assembly as claimed in claim 4 wherein the pivotable safety hook is adapted such that the safety hook is pivotable out of engagement in the front dock by actuating the slidable assembly to move the rear dock to its most forward position.

6. A coupler assembly for coupling an attachment to a vehicle, the attachment having a forward connecting pin and a rear connecting pin, the coupler having;

a chassis that is connectable to the vehicle, the chassis supporting a first component having at least one forward dock that is configured to receive the forward connecting pin of the attachment and the chassis further supporting a second component having at least one rear dock that is configured to receive the rear connecting pin of the attachment; wherein the second component is a slidable assembly slidable in a forward and aft direction relative to the forward dock; and wherein the second component includes at least one rear connecting pin locking member, wherein the at least one rear connecting pin locking member has a substantially "C" shape and this substantially C-shape curves over a control pin, and the control pin is movable by an actuator so as to move the control pin forwards and rearwards relative to the chassis;

wherein the at least one rear connecting pin locking member is movable to an extended position by the actuator moving the control pin rearwards relative to the chassis;

thereby causing the at least one rear connecting pin locking member to move from a retracted position above at least one complementary shaped slot in the second component, through the at least one complementary shaped slot in the second component; and thereby transitioning the at least one rear connecting pin locking member to the extended position, which extended position engages with and locks in place the rear connecting pin and thereby prevents the release of the rear connecting pin from the rear dock;

wherein the at least one rear connecting pin locking member is movable to the retracted position by the actuator moving the control pin forwards relative to the chassis;

thereby causing the at least one rear connecting pin locking member to move upwards through the at least one complementary shaped slot in the second component; and thereby transitioning the at least one rear connecting pin locking member to the retracted position that is above the at least one complementary shaped slot in the second component, which retracted position disengages from and releases the rear connecting pin and thereby allows release of the rear connecting pin from the rear dock;

the same actuator further controls the position of the second component relative to the position of the first component; and wherein the at least one rear connecting pin locking member is a pair of connecting pin locking members, and for the pair of rear connecting pin locking members, each rear connecting pin locking member is independently biased by a biasing means into its extended position.

7. The coupler assembly as claimed in claim 6 wherein the at least complementary shaped slot is a pair of complementary shaped slots.

8. The coupler assembly as claimed in claim 7 wherein the pair of rear connecting pin locking members are spaced apart and proximate the side edges of the slidable assembly.

9. The coupler assembly as claimed in claim 6 wherein the first component further includes a pivotable safety hook.

10. The coupler assembly as claimed in claim 9 wherein the pivotable safety hook is adapted such that the safety hook is pivotable out of engagement in the front dock by actuating the slidable assembly to move the second dock to its most forward position.

* * * * *